US011154134B2

(12) United States Patent
Albrecht et al.

(10) Patent No.: US 11,154,134 B2
(45) Date of Patent: Oct. 26, 2021

(54) SLIDING ELEMENT GUIDE SYSTEM

(71) Applicant: Grass GmbH, Hoechst (AT)

(72) Inventors: Markus Albrecht, Lustenau (AT); Filip Rihtarec, Fussach (AT); Franz Reischl, Schwarzenberg (AT)

(73) Assignee: Grass GmbH, Hoechst (AT)

( * ) Notice: Subject to any disclaimer, the term of this patent is extended or adjusted under 35 U.S.C. 154(b) by 0 days.

(21) Appl. No.: 16/209,229

(22) Filed: Dec. 4, 2018

(65) Prior Publication Data

US 2019/0166999 A1 Jun. 6, 2019

(30) Foreign Application Priority Data

Dec. 4, 2017 (DE) ..... 10 2017 128 751.5

(51) Int. Cl.
*A47B 88/45* (2017.01)
*A47B 88/49* (2017.01)
*A47B 88/493* (2017.01)

(52) U.S. Cl.
CPC ..... *A47B 88/45* (2017.01); *A47B 88/49* (2017.01); *A47B 88/493* (2017.01);
(Continued)

(58) Field of Classification Search
CPC ..... A47B 88/45; A47B 88/49; A47B 88/493; A47B 2210/001; A47B 2210/0013; A47B 2210/007; A47B 2210/0072; A47B 88/40
(Continued)

(56) References Cited

U.S. PATENT DOCUMENTS 5,570,943 A * 11/1996 Schroder ..... A47B 88/493 312/334.11
5,882,100 A * 3/1999 Rock ..... A47B 88/493 312/334.34

(Continued)

FOREIGN PATENT DOCUMENTS

DE 39 21 858 A1 1/1991
DE 201 11 586 U1 10/2001

(Continued)

OTHER PUBLICATIONS

German Search Report (Application No. 10 2017 128 751.5) dated Oct. 10, 2018.

(Continued)

*Primary Examiner* — James O Hansen
(74) *Attorney, Agent, or Firm* — Burr & Brown, PLLC

(57) ABSTRACT

Sliding element guide system for furniture including a cabinet unit rail, central rail, sliding element rail, and a carriage such that the cabinet unit rail, central rail, and sliding element rail are mounted so as to be movable in relation to one another. The system also includes synchronization means including a synchronization element to synchronize movements of elements of the system. Two identical synchronization elements are present on the central rail and are rotatably disposed on the central rail. The synchronization elements are disposed so as to be mutually opposite and mutually spaced apart on both sides of the central rail. The synchronization elements are configured on mutually opposite end sides of the central rail or on mutually opposite external sides of the central rail.

11 Claims, 10 Drawing Sheets

(52) U.S. Cl.
CPC ... *A47B 2210/001* (2013.01); *A47B 2210/007* (2013.01); *A47B 2210/0013* (2013.01); *A47B 2210/0072* (2013.01)

(58) Field of Classification Search
USPC ..... 312/330.1, 334.1, 334.6, 334.8, 334.12
See application file for complete search history.

(56) References Cited

U.S. PATENT DOCUMENTS 6,347,849 B1 * 2/2002 Muterthies ..... A47B 88/487 312/334.12
6,945,620 B2 * 9/2005 Lam ..... A47B 88/493 312/334.12
7,866,772 B1 * 1/2011 Chen ..... A47B 88/493 312/334.9
8,833,880 B2 * 9/2014 Chung ..... A47B 88/437 312/334.11
2005/0231083 A1 * 10/2005 Garcie, Jr. ..... A47B 88/467 312/333
2013/0076221 A1 * 3/2013 Hammerle ..... F16C 33/34 312/334.1
2014/0009053 A1 * 1/2014 Chung ..... A47B 88/437 312/334.18
2015/0257536 A1 * 9/2015 Chen ..... A47B 88/493 384/18
2016/0242545 A1 * 8/2016 Violand ..... F16C 29/005

FOREIGN PATENT DOCUMENTS

DE 203 07 757 U1 7/2003
DE 10 2005 016 418 A1 11/2005
DE 10 2010 060 583 A1 5/2012

OTHER PUBLICATIONS

Extended European Search Report (Application No. 18 20 9748.5) dated Mar. 14, 2019.

* cited by examiner

SLIDING ELEMENT GUIDE SYSTEM

This application claims the benefit under 35 USC § 119(a)-(d) of German Application No. 10 2017 128 751.5 filed Dec. 4, 2017, the entirety of which is incorporated herein by reference.

FIELD OF THE INVENTION

The present invention relates to a sliding element guide system.

BACKGROUND OF THE INVENTION

Guide rails, or guide systems, respectively, for a sliding element, in particular, a sliding element of an item of furniture or of a domestic appliance such as, for example, a kitchen apparatus, are known in various embodiments.

For example, so-called part-pullouts as guide systems having two guide rails, or full pullouts having three guide rails, are used in the case of a pullout functional unit, wherein the rails are movable relative to one another in a telescopic manner.

A sliding element such as, for example, a drawer, a shelf base, a food tray, or the like, is typically received in a displaceable manner by way of exactly two separate functional units of the same type of a part-pullout or of a full pullout. The respective functional unit of the pullout guide is preferably fastened to an internal side of a furniture cabinet unit or of a housing of a domestic appliance or kitchen apparatus, respectively.

A guide system, or a guide rail, respectively, must meet high technical and economic requirements, and further optimizations in this respect are to be pursued.

SUMMARY OF THE INVENTION

It is an object of the present invention to further improve guide systems of the type mentioned at the outset, the provision thereof, and corresponding items of furniture or domestic appliances or kitchen apparatuses, respectively. In particular, the guide systems are to be optimized with a view to a comparatively high mechanical load-bearing capacity and/or improved economical production.

The present invention proceeds from a sliding element guide system, in particular, a linear guide system, for an item of furniture or for a domestic appliance, for example, for a kitchen apparatus, wherein the sliding element guide system has a cabinet unit rail, a central rail, and a sliding element rail, wherein the sliding element guide system has a carriage such that the cabinet unit rail, the central rail, and the sliding element rail are mounted so as to be movable in relation to one another, wherein the sliding element guide system comprises synchronization means so as to synchronize movements of elements of the sliding element guide system, wherein the synchronization means have a synchronization element.

The sliding element guide system is configured, for example, in the form of a full pullout. The full pullout in the assembled state comprises two carriages, for example. It is conceivable for the full pullout to have two identical carriages. However, it is also imaginable that the full pullout comprises two dissimilar carriages, the two carriages differing from one another, in particular, exclusively in terms of the lengths thereof, for example.

The sliding element guide system is, advantageously, a linear guide system. For example, the sliding element guide system is provided for disposal on an item of furniture or a domestic appliance, for example, as a furniture guide system or as a domestic appliance guide system. This is furthermore based on an alignment of the guide rails of the sliding element guide system in the use state, or installed state, respectively, of the sliding element guide system on an item of furniture or on a domestic appliance such as, for example, a kitchen apparatus.

The core concept of the present invention lies in that two identical synchronization elements are present on the central rail, wherein the synchronization elements are rotatably disposed on the central rail, wherein the synchronization elements are disposed so as to be mutually opposite and mutually spaced apart on both sides of the central rail, wherein the synchronization elements are configured on mutually opposite end sides of the central rail or on mutually opposite external sides of the central rail. On account thereof, movements of elements of the sliding element guide system are advantageously capable of being synchronized. Elements of the sliding element guide system are, in particular, understood to be the rail elements such as the cabinet unit rail, the central rail, and the sliding element rail, as well as the carriage.

Exactly two synchronization elements are advantageously disposed on the central rail. For example, the synchronization elements are configured for synchronizing a movement of exactly two or exactly three elements of the guide system. The synchronization elements are identical, for example.

The sliding element guide system having synchronization elements disposed thereon is preferably configured in such a manner that at least two synchronization elements cannot simultaneously roll across an, in particular, imaginary, for example, continuous, plane, a continuous planar face, or a continuous planar plate, wherein the plane, the face, or the plate does not intersect the central rail, in particular, the guide system.

The central rail is advantageously configured as a hollow section. The hollow section is preferably configured as a hollow section that is circumferentially closed across an at least substantial length. The hollow section is to be understood as a profile, wherein, for example, a cavity of the profile is substantially enclosed at least circumferentially in relation to the longitudinal axis by way of wall portions of the profile such as an external side, for example, a horizontal wall portion, or an, in particular, vertically running side wall portion, for example, a central wall portion, and optionally further wall portions. The synchronization elements are present, for example, on mutually spaced apart and, for example, parallel running side wall portions. The cavity is preferably a material-free hollow volume which toward the outside, or in the radial direction toward a central longitudinal axis of the guide rail, which is present, for example, so as to run centrally in the hollow volume, is delimited by the wall portions. The hollow section is preferably open at the end side, for example, at the end sides.

The central rail, or the hollow section, respectively, for forming an upper side and a lower side of the central rail by way of in each case one separate central rail horizontal wall portion, comprises two part-regions which in the cross section is in each case formed so as to be triangular from a central rail horizontal wall portion and two central rail side wall portions adjoin the central rail horizontal wall portion in an angled manner. The cross section of the hollow section has approximately an outline contour of an egg timer, for example, or is in the shape of a dumbbell having a central constricted region and two end-side regions that are widened in the height direction, for example.

It is furthermore proposed that the cabinet unit rail and the sliding element rail are configured so as to be C-profile-shaped, wherein the cabinet unit rail has a cabinet unit rail horizontal wall portion and two cabinet unit rail side wall portions, wherein the cabinet unit rail side wall portions are present so as to be mutually spaced apart, wherein the sliding element rail has a sliding element rail horizontal wall portion and two sliding element rail side wall portions, wherein the sliding element rail side wall portions are present so as to be mutually spaced apart, wherein the sliding element rail side wall portions and/or the cabinet unit rail side wall portions comprise/s a planar raceway for synchronization elements of the sliding element guide system, wherein a plane of extent of the raceway of the sliding element rail side wall portion and/or a plane of extent of the raceway of the cabinet unit rail side wall portion extend/s along a longitudinal extent of the rail elements, wherein the central rail is present so as to run between the cabinet unit rail side wall portions and/or the sliding element rail slide wall portions, wherein the plane of extent of the raceway of a sliding element rail side wall portion in relation to the plane of extent of the raceway of a further sliding element rail side wall portion encloses a sliding element rail angle, wherein the sliding element rail angle is in an angular range between 0° and less than 180°, and/or wherein the plane of extent of the raceway of a cabinet unit rail side wall portion in relation to the plane of extent of the raceway of a further cabinet unit rail side wall portion encloses a cabinet unit rail angle, wherein the cabinet unit rail angle is in an angular range between 0° and less than 180°.

For example, the plane of extent of a raceway of a sliding element rail side wall portion, and/or the plane of extent of a raceway of a cabinet unit rail side wall portion have/has a component of extent transverse to a longitudinal extent of the sliding element rail and/or transverse to a longitudinal extent of the cabinet unit rail and/or transverse to a longitudinal extent of the central rail. The cabinet unit rail and/or the sliding element rail are/is advantageously configured so as to be C-profile-shaped.

The central rail is preferably configured as a hollow section that is enclosed by central rail wall portions, wherein the central rail wall portions comprise two central rail central wall portions, wherein the central rail central wall portions extend along and transversely to a longitudinal extent of the central rail, wherein the central rail central wall portions are present so as to be mutually opposite and mutually spaced apart.

An internal angle between 30° and 70° is preferably configured between the central rail horizontal wall portion, in particular, between a plane of extent of the central rail horizontal wall portion, and a central rail side wall portion, in particular, a plane of extent of the central rail side wall portion. For example, both central rail side wall portions are present on the central rail horizontal wall portion so as to be angled at the same internal angle. A central rail central wall portion advantageously adjoins a central rail side wall portion. For example, a central rail central wall portion is present so as to be angled in relation to the central rail side wall portion. For example, a central rail central wall portion in the longitudinal extent of the central rail and in, for example, a vertical direction of extent advantageously extends transversely, in particular, perpendicularly, in relation to a plane of the central rail horizontal wall portion.

The carriage advantageously comprises a carriage cage, wherein the carriage cage has, in particular, exactly one cage central element and, in particular, exactly two lateral cage side elements, wherein the cage side elements are in each case connected to the cage central element so as to be mutually opposite and mutually spaced apart, wherein a plane of extent of a cage side element is present so as to be angled in relation to a plane of extent of the cage central element, wherein the plane of extent of a cage side element and the plane of extent of the cage central element enclose an angle of less than 90°.

On account thereof, the carriage is capable of being disposed on the guide rails of the guide system in such a manner that the carriage is held on the guide rails so as to be perpendicular to a direction of movement of the guide rails. The carriage, in particular, the carriage cage, is advantageously present in such a manner that the plane of extent of a cage side element and the plane of extent of the cage central element in a state prior to an assembly of the carriage on the guide system enclose an angle of less than 90 degrees.

In one advantageous design embodiment of the carriage, a cage side element is connected to the cage central element in an articulated manner by way of a joint, for example, an integral hinge. The cage side elements are advantageously in each case connected to the cage central element in an articulated manner by way of a joint. For example, each cage side element is connected to the cage central element by means of two or more joints, in particular, integral hinges. The integral hinge advantageously extends in the longitudinal direction of the carriage. The joint is preferably configured on the longitudinal side of the cage central element. Production of the carriage is facilitated on account thereof. It likewise proves advantageous for the carriage to have two carriage cages and a connection element, wherein the connection element connects the carriage cages to one another such that the carriage cages are present so as to be mutually spaced apart. The carriage cages and the connection element of the carriage are advantageously present as separate components. The carriage cage and the connection element are preferably producible in a mutually independent manner. It is also conceivable for the carriage to be configured so as to be integral. It is moreover proposed that the connection element has a connection central element and a connection side element, wherein a plane of extent of a connection side element is present so as to be angled in relation to a plane of extent of the connection central element, wherein the plane of extent of a connection side element and the plane of extent of the connection central element enclose an angle of less than 90 degrees. The guide system advantageously comprises two carriages that differ, in particular, exclusively in terms of the lengths thereof. For example, the carriages of the guide system are configured so as to be identical.

In one advantageous embodiment of the sliding element guide system, the synchronization element is present as a friction wheel, a gear wheel, and/or as a deflection roller. For example, the synchronization element is present as a gearbox element or a gearbox means, for example, in the form of a gearbox. Synchronization of elements of the guide system is implemented in a comparatively simple manner on account thereof.

It is moreover advantageous for the synchronization element to be disposed on the central rail and to contact a surface, in particular, a raceway, of a sliding element rail side wall portion and/or a surface, in particular, a raceway, of a cabinet unit rail side wall portion. The friction wheel is advantageously configured on the central rail central wall portion. For example, an axis of the synchronization element is aligned so as to be parallel with a normal of the central rail central wall portion. For example, the synchronization element is disposed so as to project on the central rail central wall portion. Synchronization element is preferably disposed on the end side of the central rail. For example, a rotation axis of the synchronization element is aligned so as to be parallel with a plane of extent of the central rail central wall portion. For example, the synchronization element is configured partially, in particular, completely, in the cavity of the central rail. For example, the synchronization element by way of more than 80%, in particular, by way of more than 90%, extends into the cavity of the central rail. For example, the synchronization element is mounted so as to be movable, for example, rotatable, on the central rail central wall portion or on the central rail horizontal wall portion.

It likewise proves advantageous for the synchronization means to have two synchronization elements which are disposed so as to be mutually opposite and spaced apart on the central rail. Synchronization of elements of the guide system is improved on account thereof, is, in particular, configured so as to be redundant. A synchronization element is advantageously configured for synchronizing a movement of the cabinet unit rail and a movement of the sliding element rail. On account thereof, it is also conceivable that comparatively more elements of the guide system can be mutually synchronized than is the case with known guide system synchronization mechanisms. For example, on account thereof, the guide rails can be mutually synchronized, and/or the carriages of the guide system can also be, in particular, simultaneously mutually synchronized.

The central rail advantageously comprises two friction wheels or deflection rollers. For example, the friction wheels are configured so as to be spaced apart and mutually opposite on the central rail on mutually opposite central rail central wall portions of the central rail. The synchronization element is advantageously mounted so as to be movable, in particular, rotatable, on two central rail horizontal wall portions that are present so as to be mutually opposite and mutually spaced apart. The synchronization element, in particular, the deflection roller, is advantageously mounted so as to be movable on mutually opposite and mutually spaced apart central rail horizontal wall portions in the region of an end, for example, an end side, of the central rail.

It is furthermore proposed that the synchronization element has a curved shell face. The synchronization element is present, for example, as a toroidal or conical friction wheel, for example. The raceway of the synchronization element, for example, of the friction wheel, is configured so as to be cambered, for example.

The cabinet unit rail and the sliding element rail preferably comprise raceways on which the friction wheel in the assembled state rolls in a relative movement of the rails of the guide system. The raceways are preferably aligned so as to be angled in relation to the axis of the friction wheel such that linear contact of the friction wheel with the respective rail is implemented.

It also proves advantageous for the synchronization element to be pretensioned in a direction transverse to a direction of movement of the rails of the sliding element guide system. On account thereof, comparatively reliable, for example, friction-fitting, contact of the friction wheel with raceways of the rails of the guide system is implemented, for example. The synchronization element is present on the central rail in such a manner, for example, that the synchronization element is pretensioned in the disposed state of the central rail on the guide system.

It is moreover advantageous for the synchronization means to comprise a rocker element, wherein the rocker element is disposed on a central rail side wall portion, in particular, on the central rail central wall portion, wherein the synchronization element is assembled so as to be movable on the rocker element such that an equalization of tolerance is implemented. For example, the synchronization element is disposed so as to be rotatable on the rocker element. The rocker element is advantageously present so as to be pivotable on the central rail. For example, a pivot axis of the rocker element is aligned so as to be parallel with a rotation axis of the synchronization element. Each synchronization element is preferably disposed on the central rail by way of a rocker element.

In one advantageous design embodiment, a gear means, for example, in the form of a rack, is configured on the surface, in particular, the raceway, of the sliding element rail side wall portion and/or on the surface, in particular, the raceway, of the cabinet unit rail side wall portion, for example, on a carriage. On account thereof, a coupling, in particular, in terms of gearing, of the sliding element rail and/or of the cabinet unit rail is implementable by way of the synchronization element. For example, the synchronization element is present as a gear wheel, and teeth of the gear wheel in the disposed state of the guide system engage in the rack such that the gear wheel is coupled to the rack. It also proves advantageous for the carriage to have a rack or a pinion, or a rack-type member, respectively.

It moreover proves advantageous for the surface, in particular, the raceway, of the sliding element rail side wall portion and/or the surface, in particular, the raceway, of the cabinet unit rail side wall portion to be present so as to be structured. For example, the surface is present in the manner of sandpaper and/or so as to be roughened. It is imaginable for the surface to have a mesh structure. The surface, in particular, has a comparatively high coefficient of friction. On account thereof, contact, in particular, frictional contact, between a synchronization element and the surface of the sliding element rail side wall portion and/or the surface of the cabinet unit rail side wall portion is improved.

It is moreover advantageous for the sliding element guide system to comprise two carriages, wherein the synchronization means are configured for synchronizing movements of the carriages.

It is furthermore proposed that the synchronization means have a cable pull, wherein the cable pull is present so as to enclose the central rail in the manner of a loop, wherein the cable pull is mounted so as to be movable on the synchronization elements. The synchronization means preferably comprise a cable pull system. The cable pull in the disposed state is advantageously, in particular, fixedly connected to a coupling member of the sliding element rail and/or a coupling member of the cabinet unit rail. The cable pull is advantageously mounted so as to be movable on two synchronization elements, wherein the synchronization elements are disposed on the end side on the hollow section.

It moreover proves advantageous for the synchronization means to have two cable pulls. For example, one cable pull couples to the sliding element rail, and the further cable pull couples to the cabinet unit rail. The cable pulls are disposed so as to be mutually parallel, for example, in particular, so as to be offset and spaced apart, on the central rail. The cable pulls are advantageously mounted so as to be movable by way of the same synchronization elements. It is also conceivable for the cable pulls to be mounted so as to be movable by way of different synchronization elements. On account thereof, different elements of the sliding element guide system are capable of being mutually synchronized by way of each cable pull. The cable pulls advantageously transmit a movement between elements of the guide system directly, in particular, without any positive and/or negative gearing. However, it is also conceivable for the synchronization means to be present in such a manner that one synchronization element and/or a plurality of synchronization elements transmits/transmit a movement of one element of the guide system to another element by way of a positive and/or negative gearing.

It is also proposed that the synchronization means are configured for synchronizing a movement of the cabinet unit rail with a movement of the sliding element rail. It likewise proves advantageous for the synchronization means to be configured for synchronizing a movement of the central rail with a movement of the cabinet unit rail and/or a movement of the sliding element rail.

It moreover proves advantageous for the synchronization means to comprise an entrainment element which is configured for coupling to an ejector and/or a receiver of a motion mechanism. The motion mechanism is configured, for example, as an automatic retraction mechanism or an ejection, or ejector unit, respectively, for example, an automatic touch-latch mechanism. The motion mechanism is advantageously disposable, in particular, directly, on the sliding element guide system, for example, on the cabinet unit rail. The cable pull comprises the entrainment element, for example.

Furthermore proposed is an item of furniture or domestic appliance having a sliding element guide system according to one of the modifications discussed above.

BRIEF DESCRIPTION OF THE DRAWINGS

Further features and advantages of the present invention are explained in more detail by means of the exemplary embodiments of the present invention illustrated in the figures.

DETAILED DESCRIPTION OF THE INVENTION

The same reference signs are used to some extent hereunder for equivalent elements of different exemplary embodiments.

Figure 1:
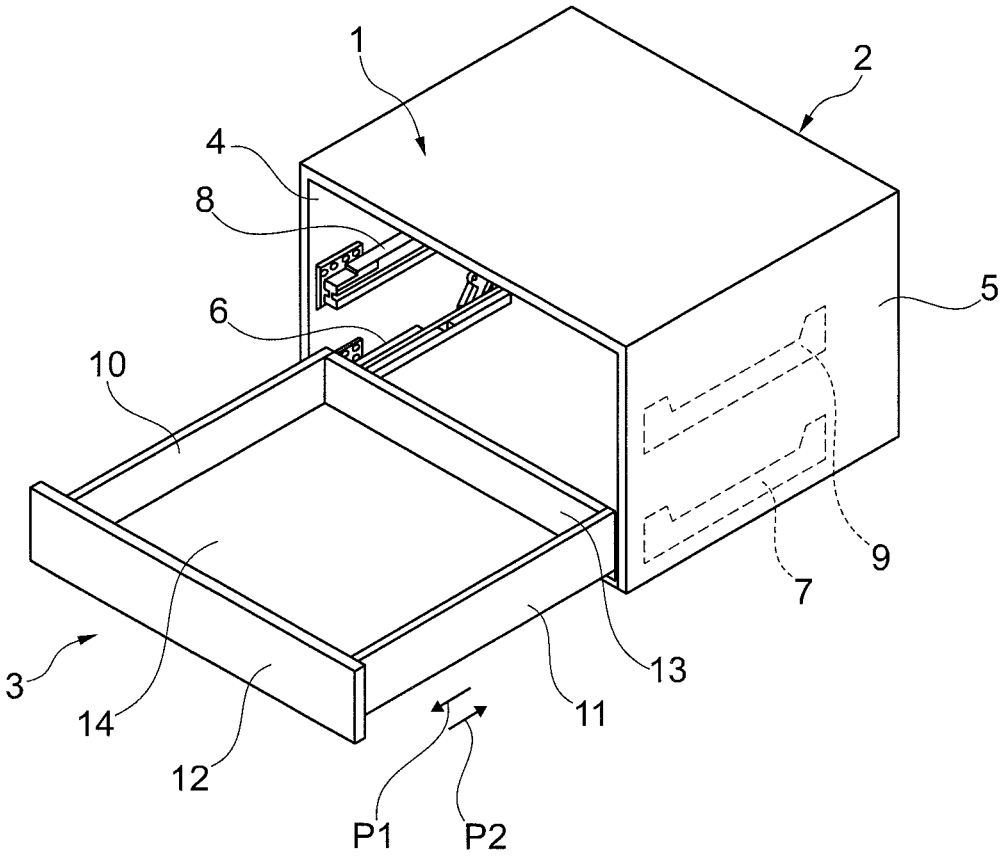
FIG. 1 shows a schematically illustrated item of furniture according to the present invention in a perspective view from obliquely above, having a drawer received so as to be displaceable on the item of furniture.

FIG. 1 very schematically shows an item of furniture 1 according to the present invention in a use state, having a hollow cuboid furniture cabinet unit 2 and a sliding element configured as a drawer 3, wherein the drawer 3 is received so as to be displaceable on the furniture cabinet unit 2. The furniture cabinet unit 2 comprises two opposite vertical sidewalls 4 and 5, between which the drawer 3 by way of a guide system having telescopic guide means, for example, in an underfloor configuration, or a first rail full pullout 6 and a second rail full pullout 7, respectively, is capable of being pulled out from the furniture cabinet unit 2 in the horizontal direction according to P1 of a state accommodated in the interior of the furniture cabinet unit 2, and is capable of being pushed thereinto in the opposite direction according to P2. The drawer 3 in FIG. 1 is shown in the state in which the drawer 3 is pulled to a maximum, or completely, respectively, out of the interior of the furniture cabinet unit 2. The storage volume of the drawer 3 can thus be accessed in an almost unimpeded manner from above.

When in each case, a rail part-pullout is used instead of the rail full pullouts 6, 7 on the drawer 3, the drawer 3, in the maximum pull-out state, cannot be pulled out of the interior of the furniture cabinet unit 2 in the direction P1 as far as is possible by way of the rail full pullouts 6, 7 according to the illustration in FIG. 1. The front element 12 in this case is closer to the open front side of the furniture cabinet unit 2 than is shown in the case of the drawer 3 according to FIG. 1.

The rail full pullout 6 that is fastened to the inside on the side wall 4 is located opposite the rail full pullout 7 which is obscured in FIG. 1 and is indicated by dashed lines and which is fastened to the side wall 5 at the same vertical height as the rail full pullout 6.

A further drawer which is not illustrated in FIG. 1 and which is guided in a corresponding manner by way of rail full pullouts 8 and 9 is capable of being accommodated in the furniture cabinet unit 2 above the drawer 3.

The drawer 3 has opposite drawer side walls 10, 11 which in each case comprises a constructed cavity frame, for example. The drawer 3 moreover comprises a front element 12, a rear wall 13 that in the horizontal direction lies opposite the latter, and a horizontally extending drawer base 14 which reaches up to, or is connected to, respectively, the drawer side walls 10, 11, the front element 12, and the rear wall 13.

Figure 2:
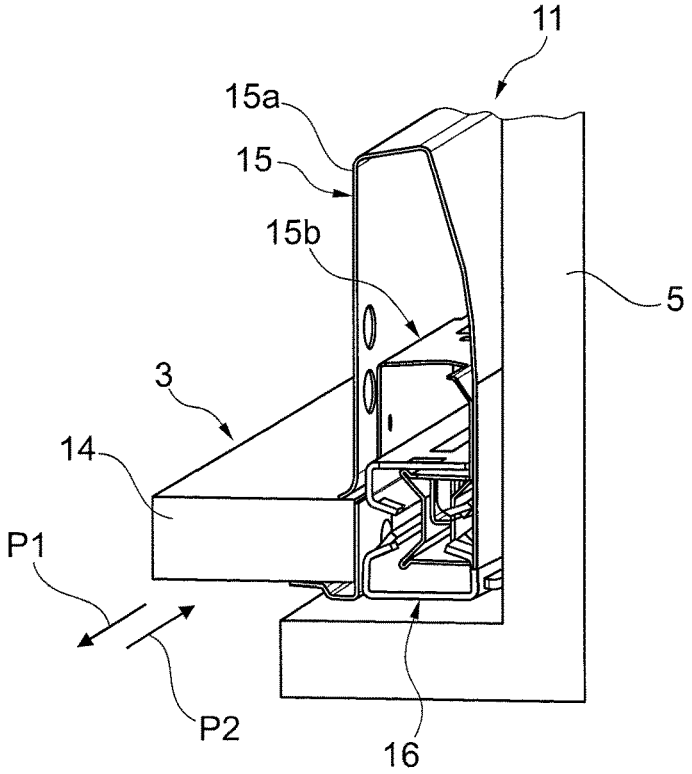
FIG. 2 shows in the cross section a perspective fragment of an item of furniture in the region of a drawer side, neighboring a furniture cabinet unit wall and a furniture cabinet unit base.
Figure 3:
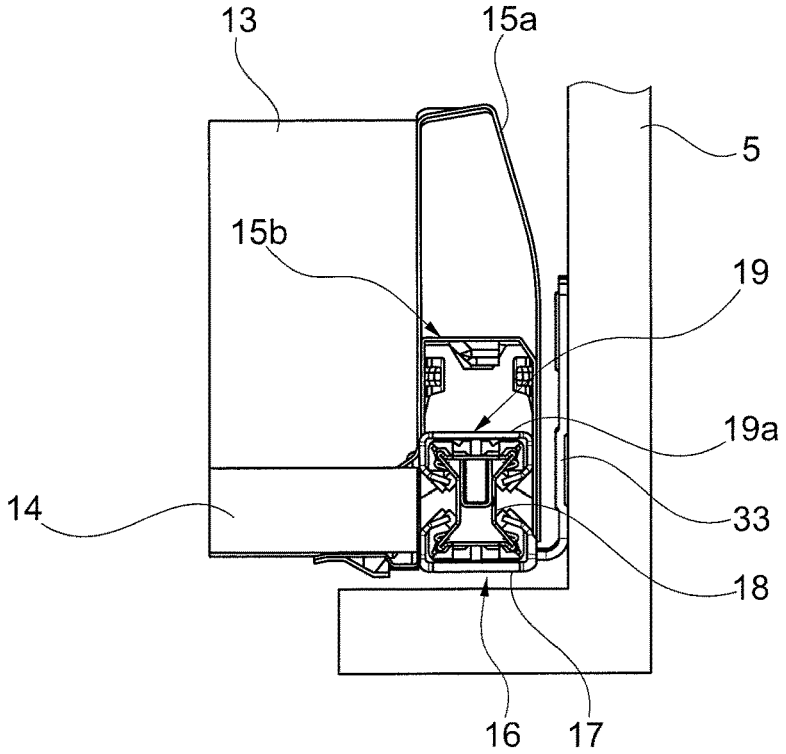
FIG. 3 shows the fragment according to FIG. 2 in an end view.
Figure 4:
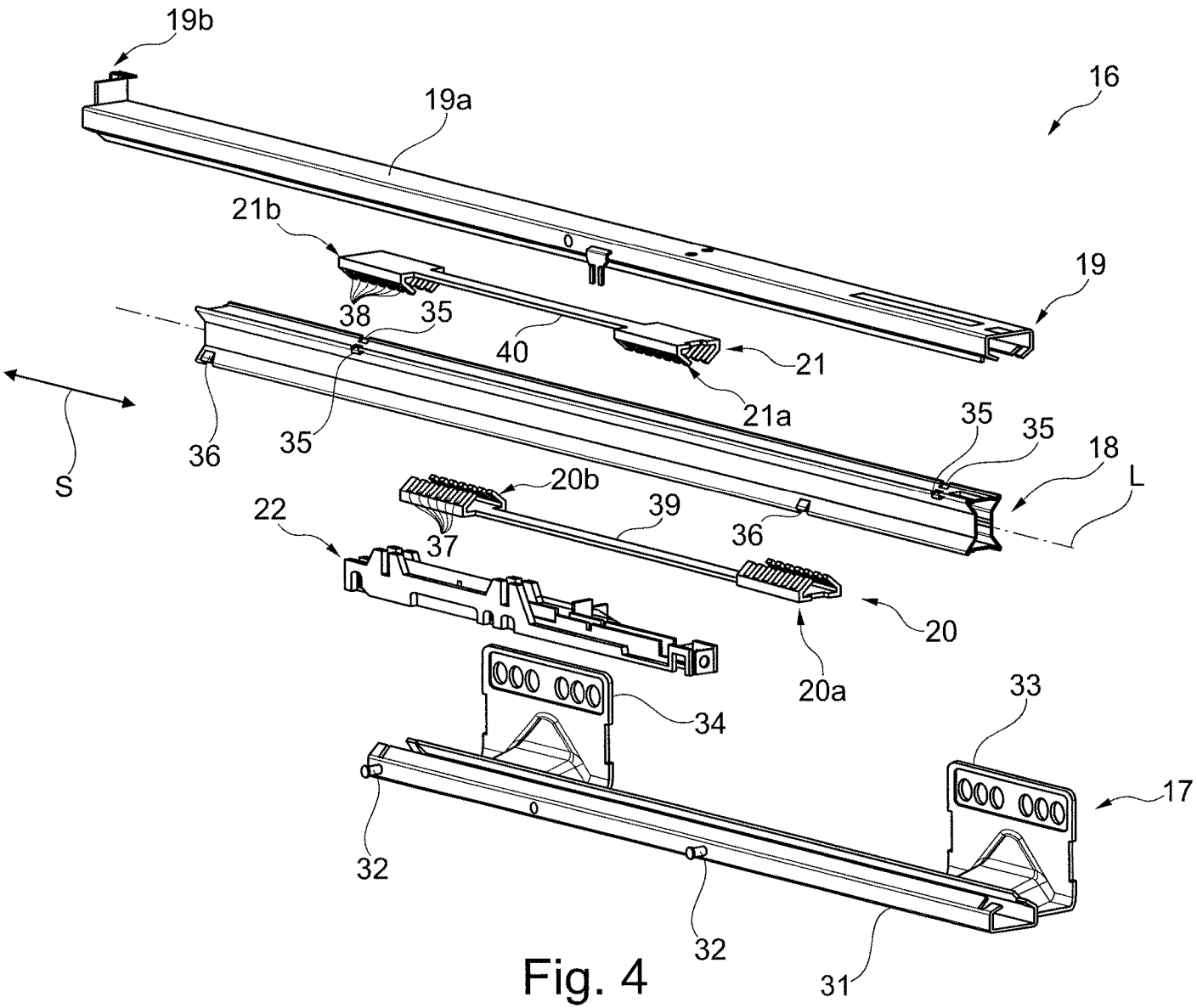
FIG. 4 shows an exploded illustration of a functional unit of a guide system.

FIGS. 2 and 3 in the region of a cabinet unit side wall 5 show a fragment of a drawer 3 which in this case of an embodiment has cavity frames, having a drawer base 14 and a drawer side wall 11 that is configured as a cavity frame 15, and a rear wall 13. The drawer 3 is received by way of two functional units of a guide system on the furniture cabinet unit 2, or by way of a rail full pullout 16 on the side wall 5, and in the same manner by way of a further cavity frame of the drawer 3 on the side wall 4 (not visible in FIG. 2). Receiving on the side wall 4 is performed by way of a further functional unit, or a further full pullout, by way of which the drawer 3 is displaceable in a linear horizontal manner in the directions P1 and P2.

The cavity frame 15 from a preferably bent sheet metal material has an external housing 15*a* and an internal structure 15*b* such that the full pullout 16 is capable of being accommodated in a recess manner in the internal volume of the cavity frame 15. The cavity frame 15 on an internal side thereof in the lower portion of the cavity frame 15, the latter is configured for receiving a longitudinal periphery of the drawer base 14.

The full pullout 16 that is formed as a functional unit of the guide system comprises three mutually telescopic guide rails, or a cabinet unit rail 17, a central rail 18, and a sliding element rail 19, respectively.

The central rail 18 is configured as a hollow section.

A sliding element to be moved, such as the drawer 3, is coupled or connected, respectively, to the sliding element rail 19, for example, is fixed to the cavity frame 15, whereas the cabinet unit rail 17 is connected to the stationary part of the item of furniture. When the full pullout 16 is used as an underfloor guide, a lower side of a sliding element, or the base thereof, respectively, is supported on an upper side 19*a* of the sliding element rail 19. A hook element 19*b* which at the rear end of the sliding element rail 19 projects upward forms a detent for a portion of a rearward external side of the sliding element, wherein for the exact positioning a portion of the hook element 19*b* that is angled so as to be parallel with the upper side 19*a* engages in a depression prepared in a matching manner in the rearward external side of the sliding element.

The full pullout 16 moreover comprises a first, or lower, respectively, carriage 20 having bearing members 37 disposed thereon, wherein the carriage 20 between the cabinet unit rail 17 and the central rail 18 acts for a load-transmitting relative movement of the rails 17, 18.

The full pullout 16 furthermore comprises a second, or upper, respectively, carriage 21 having bearing members 38 disposed thereon, wherein the carriage 21 between the central rail 18 and the sliding element rail 19 acts for a load-transmitting relative movement of the rails 18, 19.

The carriages 20 and 21, respectively, comprise two carriage cages 20*a*, 20*b*, and 21*a*, 21*b*, respectively, and a connection element 39 and 40, respectively, for example.

Pins 32, by way of which a motion mechanism 22 of the full pullout 16, for example, for injecting and/or retracting the drawer 3, is attachable, are present on a vertically standing, inwardly pointing narrower side of a rail member 31 of the cabinet unit rail 17.

Two L-shaped fastening elements 33 and 34 are part of the cabinet unit rail 17, wherein the fastening elements 33 and 34 serve for fastening or fixing, respectively, the full pullout to an internal side of the side wall of a cabinet unit, such as the side wall 5 of the furniture cabinet unit 2 of the item of furniture 1.

The guide rails 17, 18, 19 are preferably composed of a sheet metal material which, proceeding from the flat sheet metal material, is deformed, for example, by a punching and bending method, so as to form the final product of the respective guide rail.

Figure 5:
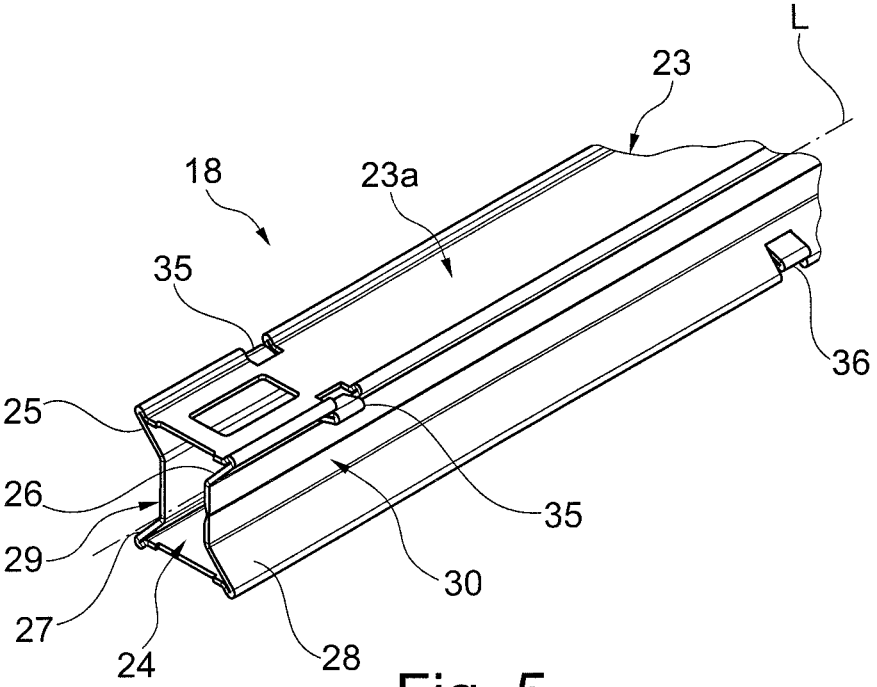
FIG. 5 shows an end portion of a central rail of the guide system according to FIG. 4, illustrated in a perspective manner.

FIG. 5 shows the front end portion of the central rail 18 relating to the use state of the full pullout 16. The central rail 18 according to the exemplary embodiment illustrated has an upper planar horizontal wall portion 23, a lower planar horizontal wall portion 24, two planar upper side wall portions 25, 26, two lower planar side wall portions 27, 28, and, in particular, vertically running central wall portions 29 and 30.

The horizontal wall portion 23 forms a distal wall, or an upper side of the central rail 18, respectively, or of the corresponding hollow section, respectively. Accordingly, the horizontal wall portion 24 forms a distal wall, or a lower side of the central rail 18, respectively, or of the hollow section, respectively.

The terminology top and bottom refers to the orientation of the full pullout 16 in the use state, or in the state attached to the item of furniture, respectively, shown, in particular, in FIGS. 2 and 3. The planes that are in each case defined by the mutually parallel horizontal wall portions 23 and 24, or the outboard or distal sides, respectively, herein are aligned so as to be at least almost horizontal.

Upper detents 35 and lower detents 36 are present on the central rail 18 for delimiting a relative movement of the lower carriage 20 and of the upper carriage 21 in relation to the central rail 18 in the longitudinal extent of the central rail 18 according to a central longitudinal axis L (cf. FIG. 5).

In the case of the fully assembled full pullout 16, the bearing members that are received on the carriages 20, 21 run on the outwardly directed sides of the central rail 18, or the horizontal wall portions 23, 24 and the side wall portions 25-28, respectively. The lower carriage 20 by way of the portions 20*a* and 20*b* thereof that support the bearing members externally encompasses the horizontal wall portion 24 and the side wall portions 27, 28. The upper carriage 21 by way of the portions 21*a* and 21*b* thereof that support the bearing members externally encompasses the horizontal wall portion 23 and the side wall portions 25, 26.

An internal angle $\alpha$ between the plane according to an internal side 41 of the horizontal wall portion 23 of the central rail 18, and the plane according to an internal side 42 of the side wall portion 26, is preferably between 20 and 70 degrees, preferably between 35 and 55 degrees, preferably approximately 45 degrees.

Figure 6:
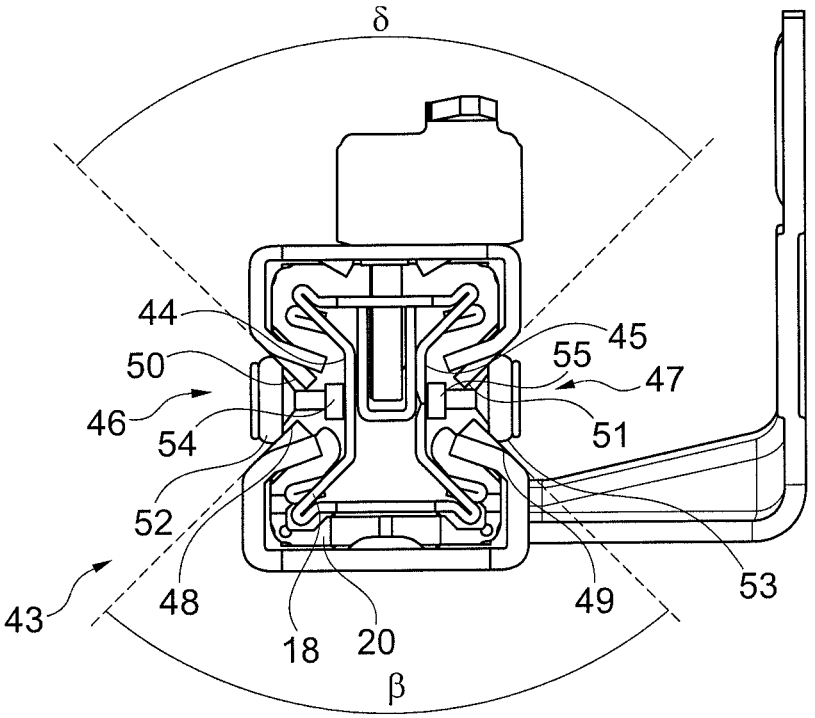
FIG. 6 shows a front view of parts of a guide system having a synchronization element.
Figure 7:
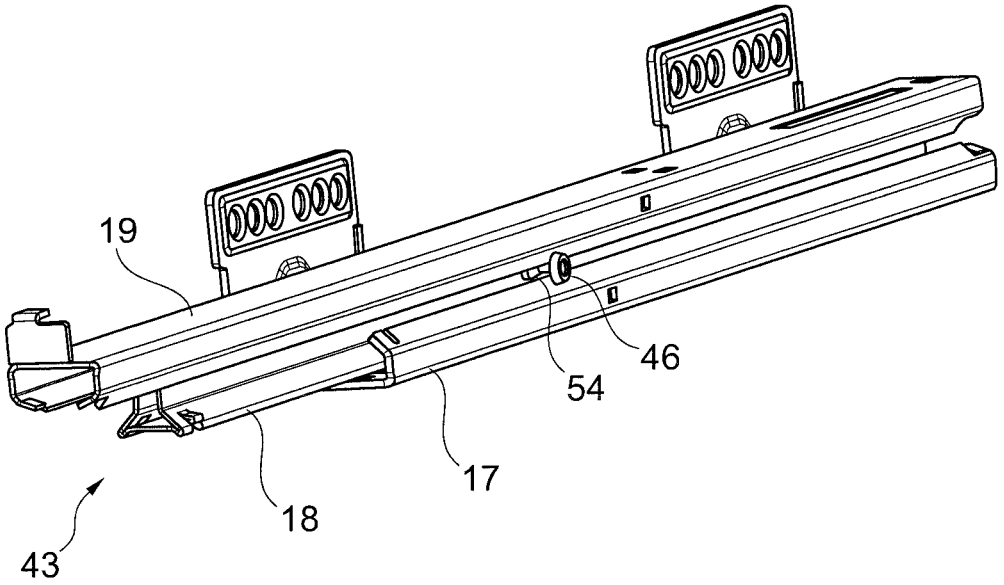
FIG. 7 shows a perspective view from the rear and obliquely from above of the guide system as per FIG. 6.
Figure 8:
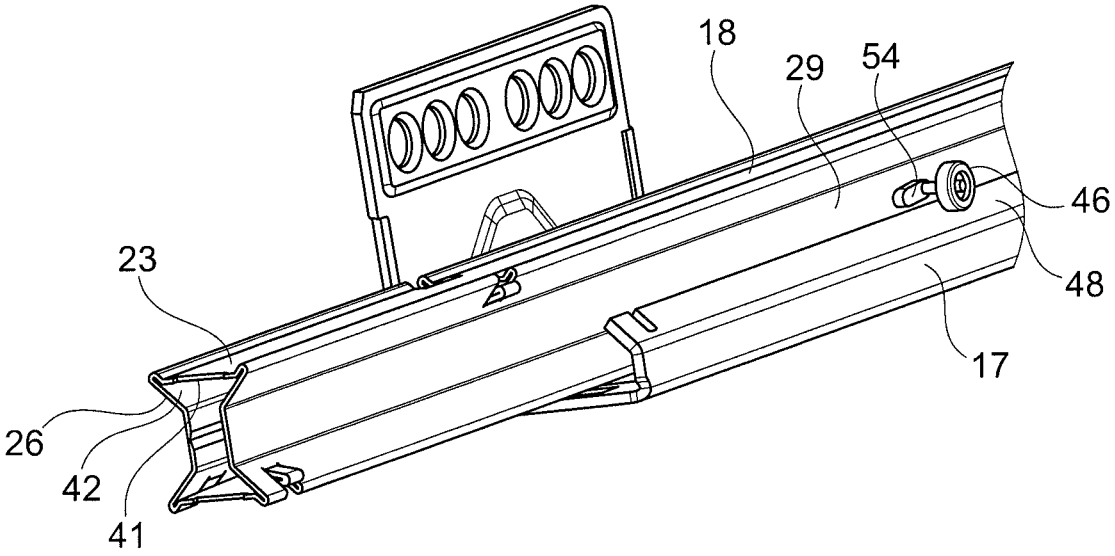
FIG. 8 shows a perspective partial view from the rear and from obliquely above of parts of a guide system according to FIG. 6.

FIGS. 6 to 8 show a first variant of a guide system 43 according to the present invention. The guide system 43, apart from the elements already described above, i.e. the cabinet unit rail 17, the central rail 18, the sliding element rail 19, and the carriages 20, 21, comprises synchronization elements in the form of wheels 46, 47 which synchronization elements are present so as to be mutually opposite and mutually spaced apart on external sides 44, 45 of the central wall portions 29, 30 of the central rail 18 (the carriage 21 in FIG. 6 is transparent). The wheels 46, 47 are disposed so as to project on the central wall portions 29, 30 of the central rail 18 in such a manner that the wheels 46, 47 in the disposed state of the central rail 18 on the guide system 43 roll on raceways 48, 49 of the cabinet unit rail 17 and on raceways 50, 51 of the sliding element rail 19. On account thereof, the wheels 46, 47 synchronize a movement of the sliding element rail 19 in relation to the cabinet unit rail 17.

Planes of extent of the raceways 48, 49 of the cabinet unit rail 17 advantageously enclose a cabinet unit rail angle $\beta$ which forms an angle of the size between 0° and less than 180°. For example, the planes of extent of the raceways 50, 51 of the sliding element rail 19 enclose a sliding element rail angle $\delta$ which forms an angle of the size between 0° and less than 180°.

The wheels 46, 47 have a curved shell face 52, 53, for example, in particular, a cambered shell face. The shell face 52, 53 of the wheels 46, 47 is advantageously configured in such a manner that the wheels 46, 47 in the disposed state of the guide system 43 are connected to the raceways 48-51 in a friction-force-fitting manner. The wheels 46, 47 on the shell face 52, 53 are rubberized, for example. Furthermore, the wheels 46, 47 are advantageously fastened to the central wall portions 29, 30 so as to be movable by means of rocker elements 54, 55.

Figure 9:
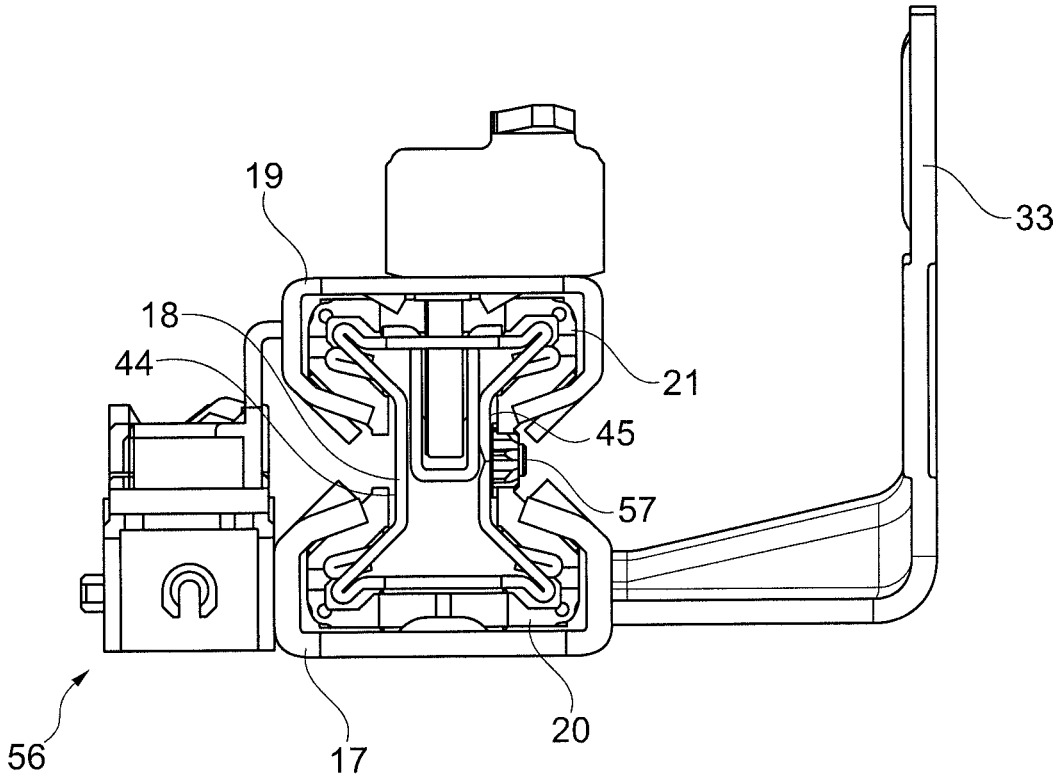
FIG. 9 shows a front view of a further guide system having a further synchronization element.
Figure 10:
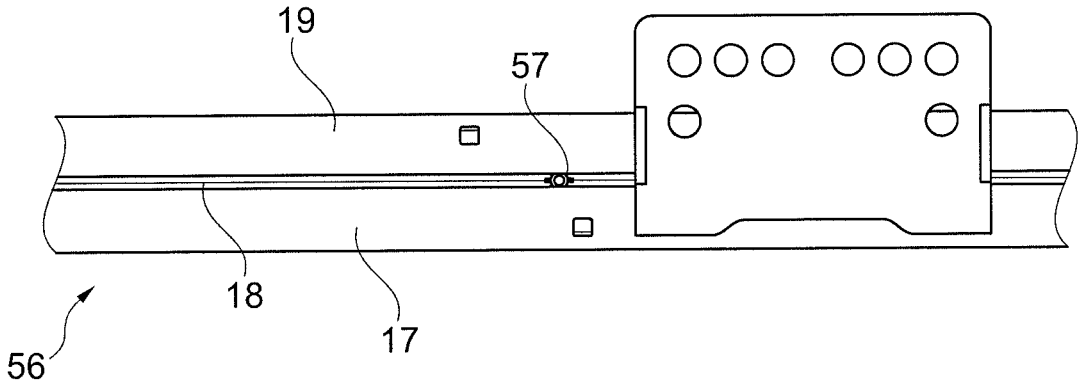
FIG. 10 shows a side view of the guide system as per FIG. 9.
Figure 11:
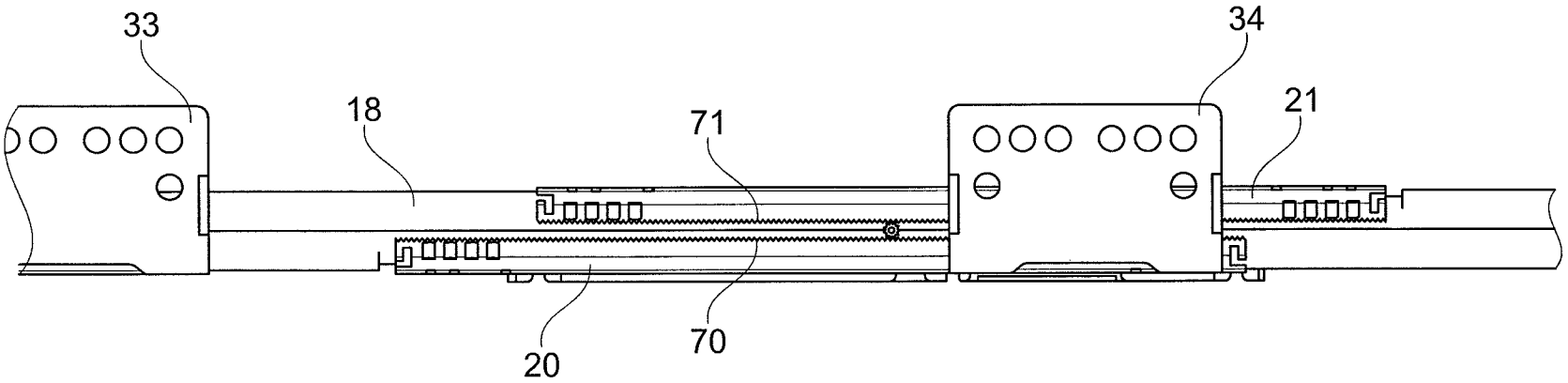
FIG. 11 shows a side view of the guide system as per FIG. 9, wherein the cabinet unit rail and the sliding element rail are shown to be transparent.

FIGS. 9 to 11 show a further variant of a guide system 56. The guide system 56, apart from the elements already described above, i.e. the cabinet unit rail 17, the central rail 18, the sliding element rail 19, and the carriages 20, 21, comprises a synchronization element in the form of a gear wheel 57 on the external side 45 of the central wall portion 30 of the central rail 18. The gear wheel 57 is fastened so as to be movable, in particular, rotatable, on the external side 45 of the central wall portion 30. It is moreover conceivable but not shown in FIGS. 9 to 11 for a further gear wheel to be present on that external side 46 of the central wall portion 29 of the central rail 18 which external side 46 is opposite the external side 45. The carriages 20, 21 of the guide system 56 furthermore advantageously comprise rack-like contours 70, 71 in which disposed state of the guide system 56 the gear wheel 57 engages, and on account thereof mutually synchronizes a movement of the carriages 20, 21. It would moreover be imaginable for the cabinet unit rail 17 and the sliding element rail 19 to have corresponding rack-like contours in which the gear wheel could engage, such that a movement of the cabinet unit rail 17 relative to the sliding element rail 19 is synchronized (not illustrated).

Figure 12:
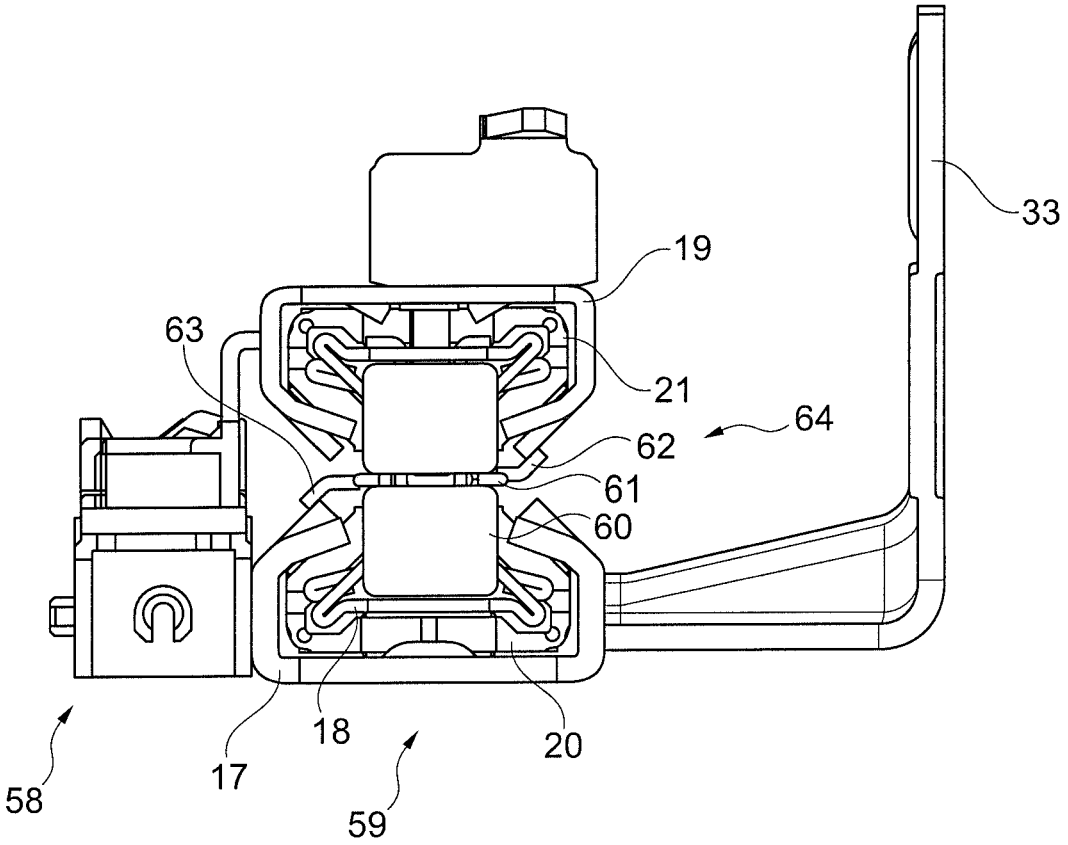
FIG. 12 shows a front view of a further guide system having a further synchronization element.
Figure 13:
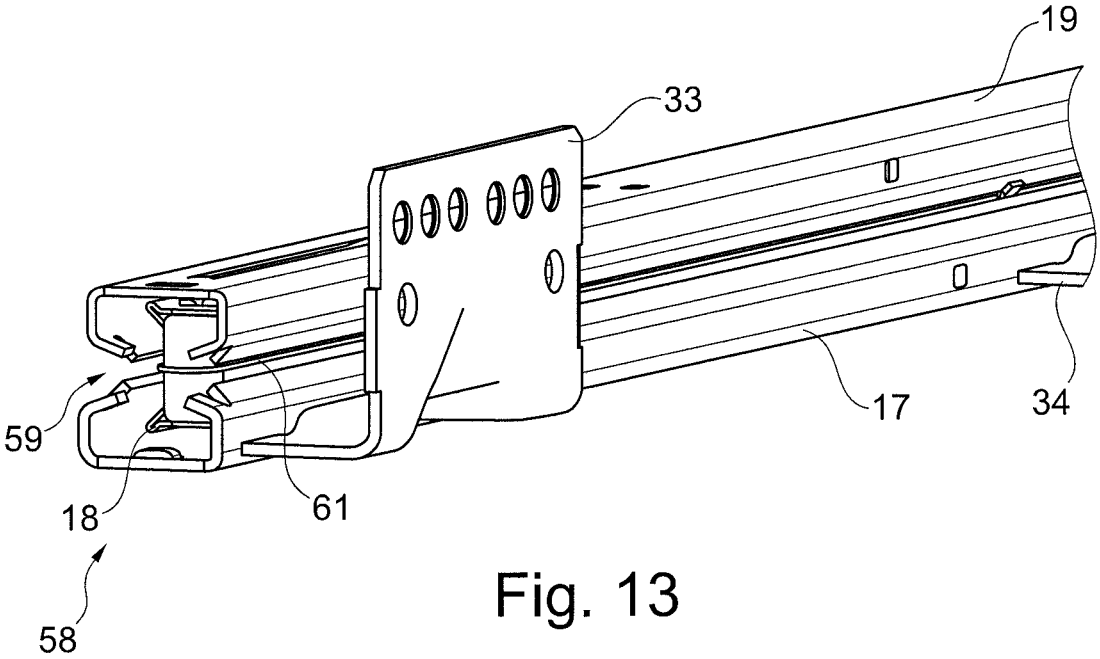
FIG. 13 shows a perspective partial view from the front and from obliquely above of the guide system according to FIG. 12.

A further variant of embodiment of a guide system 58 is shown in FIGS. 12 and 13. The guide system 58, apart from the elements already described above, i.e. the cabinet unit rail 17, the central rail 18, the sliding element rail 19, and the carriages 20, 21, comprises synchronization means in the form of deflection rollers 60 on mutually opposite end sides 59. Movements of the deflection rollers 60 are mutually synchronized by means of an encircling cable pull 61. The deflection rollers 60 under cable pull 61 advantageously form a cable pull system 64. A rotation axis of the deflection rollers 60 is advantageously configured so as to be transverse, in particular, perpendicular, to a direction of movement of the rail elements 17-19 of the guide system 58. For example, the deflection rollers 60 are mounted so as to be movable, in particular, rotatable, on the central rail 18. Two entrainment elements 62, 63 are advantageously configured on the cable pull 61. For example, the entrainment element 63 is fixedly, in particular, non-releasably, connected to the cabinet unit rail 17, and the entrainment element 62 is fixedly, in particular, non-releasably, connected to the sliding element rail 19, on account of which a movement of the cabinet unit rail 17 relative to the sliding element rail 19 is synchronized by way of the cable pull system 64.

Figure 14:
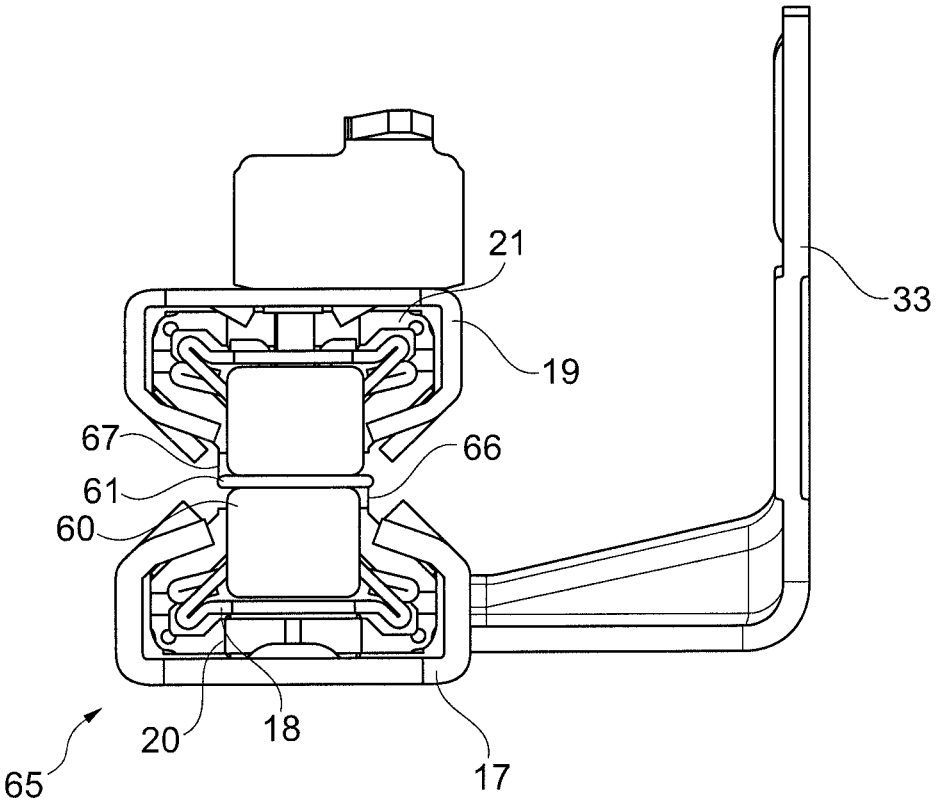
FIG. 14 shows a front view of a further variant of embodiment of a guide system.
Figure 15:
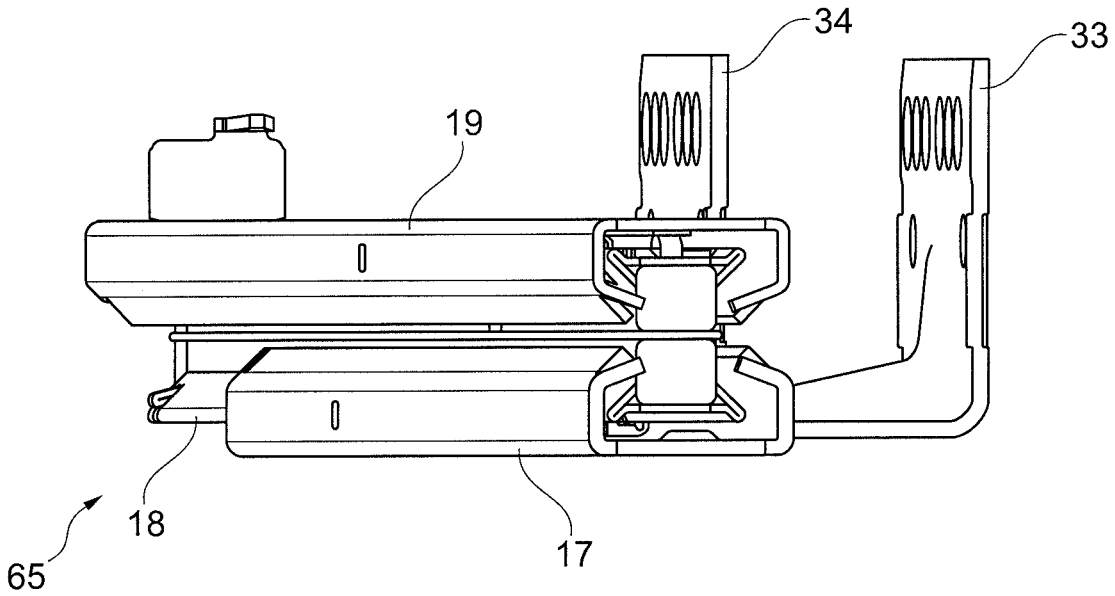
FIG. 15 shows a perspective partial view from the front and from obliquely above of the guide system according to FIG. 14.

A further embodiment of a guide system 65 can be derived from FIGS. 14 and 15. The guide system 65 differs from the preceding described guide system 58 from FIGS. 12 and 13 in that the cable pull system 64 has coupling elements 66, 67 instead of, or e.g. additionally to, the entrainment elements 62, 63. The cable pull system 64 is, in particular, non-releasably, connected to the carriages 20, 21 by way of the coupling elements 66, 67. On account thereof, the cable pull system 64 of the guide system 65 mutually is synchronizes a movement of the carriages 20, 21.

Figure 16:
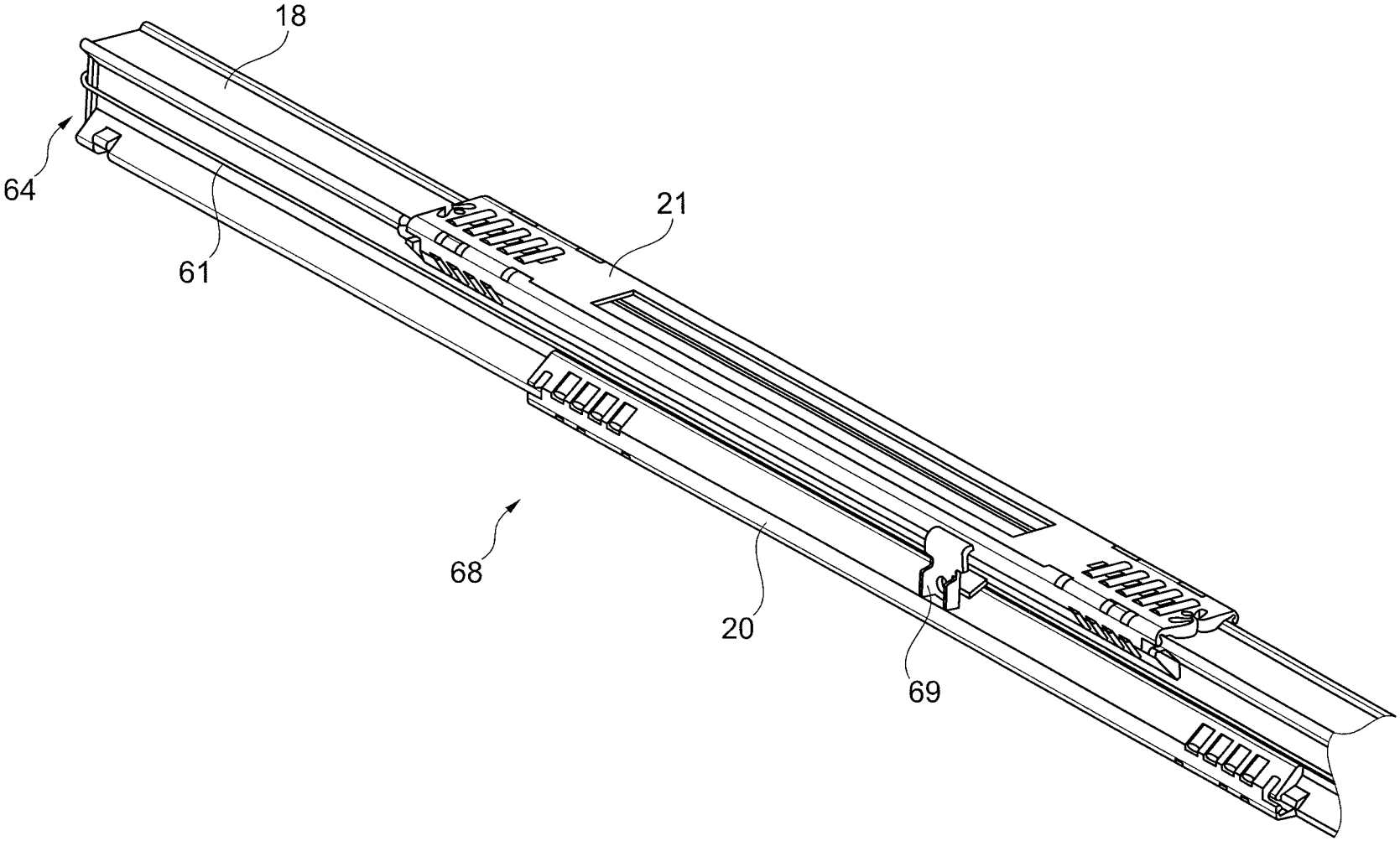
FIG. 16 shows a perspective partial view from the front and from obliquely above of part of a further variant of a guide system.

A further alternative embodiment of a guide system 68 is shown in FIG. 16. For improved clarity, only the central rail 18, the carriages 20, 21, as well as the cable pull system 64 are in FIG. 16. The cable pull system 64 of the relative embodiment of the guide system 68 of FIG. 16 comprises a coupling member 69 instead of, or additionally to, the entrainment element 62, and/or the coupling elements 66, 67. The coupling member 69 is fastened to the cable pull 61 of the cable pull system 64. The coupling member 69 is advantageously present on the guide system 68 in such a manner that a synchronization element, for example, in the form of a synchronization bar (not shown), is disposable on the coupling member 69, such that a movement of parts of the guide system 68 is capable of being synchronized with parts of a second guide system which in the disposed state on the item of furniture is present so as to be opposite the guide system 68 on the item of furniture.

LIST OF REFERENCE SIGNS

1 Item of furniture
2 Furniture cabinet unit
3 Drawer
4-5 Side wall
6-9 Rail full pullout
10-11 Drawer side wall
12 Front element
13 Rear wall
14 Drawer base
15 Cavity frame
**15*a*** Housing
**15*b*** Internal structure
16 Full pullout
17 Cabinet unit rail
18 Central rail
19 Sliding element rail
**19*a*** Upper side
**19*b*** Hook element
20 Carriage
**20*a*-20*b*** Carriage cage
21 Carriage
**21*a*-21*b*** Carriage cage
22 Motion mechanism
23-24 Horizontal wall portion
25-28 Side wall portion
29-30 Central wall portion
31 Rail member
32 Pin
33-34 Fastening element
35-36 Detent
37-38 Bearing member
39-40 Connection element
41-42 Internal side
43 Guide system
44, 45 External side
46, 47 Wheel
48-51 Raceway
52, 53 Shell face
54, 55 Rocker element
56 Guide system
57 Gear wheel
58 Guide system
59 End side
60 Deflection roller
61 Cable pull
62, 63 Entrainment element
64 Cable pull system
65 Guide system
66, 67 Coupling element

68 Guide system
69 Coupling member
70, 71 Contour

The invention claimed is:

1. A sliding element linear guide system for a furniture item or a domestic appliance, the sliding element linear guide system comprising:

a cabinet unit rail;

a central rail;

a sliding element rail;

a carriage including bearing elements, wherein the carriage comprises a first carriage associated with the cabinet unit rail and the central rail, and a second carriage associated with the sliding element rail, and wherein the cabinet unit rail, the central rail and the sliding element rail are movably mounted such that the cabinet unit rail, the central rail and the sliding element rail are moveable in relation to one another; and synchronization means having a synchronization element, wherein the synchronization means synchronizes movement of elements of the sliding element guide system, wherein the synchronization element comprises two identical synchronization elements rotatably disposed on the central rail, wherein the two identical synchronization elements are configured to be spaced apart on mutually opposite end sides of the central rail or on mutually opposite external sides of the central rail, wherein the cabinet unit rail and the sliding element rail are configured to have a C-profile-shape, wherein the cabinet unit rail has a cabinet unit rail horizontal wall portion and two cabinet unit rail side wall portions that are mutually spaced apart, wherein the sliding element rail has a sliding element rail horizontal wall portion and two sliding element rail side wall portions that are mutually spaced apart, wherein the sliding element rail side wall portions and/or the cabinet unit rail side wall portions comprise a planar raceway for the synchronization elements, wherein a plane of extent of the raceway of the sliding element rail side wall portion and/or a plane of extent of the raceway of the cabinet unit rail side wall portion extends along a longitudinal extent of the rail elements, wherein the central rail runs between the cabinet unit rail side wall portions and/or the sliding element rail side wall portions, wherein an internal angle $\alpha$ between a plane of extent of a central rail horizontal wall portion and a plane of extent of a central rail side wall portion is in a range of 30° to 70°, wherein the plane of extent of the raceway of a first sliding element rail side wall portion in relation to the plane of extent of the raceway of a second sliding element rail side wall portion encloses a sliding element rail angle $\delta$, wherein the sliding element rail angle $\delta$ is in an angular range between 0° and less than 180°, and/or wherein the plane of extent of the raceway of a first cabinet unit rail side wall portion in relation to the plane of extent of the raceway of a second cabinet unit rail side wall portion encloses a cabinet unit rail angle $\beta$, wherein the cabinet unit rail angle $\beta$ is in an angular range between 0° and less than 180°.

2. The sliding element linear guide system according to claim 1, wherein the synchronization elements are present as a friction wheels.

3. The sliding element linear guide system according to claim 1, wherein the synchronization elements disposed on the central rail each contact a raceway surface of one of the sliding element rail side wall portions and/or a raceway surface of one of the cabinet unit rail side wall portions.

4. The sliding element linear guide system according to claim 1, wherein the synchronization elements have a curved shell face.

5. The sliding element linear guide system according to claim 1, wherein the synchronization elements are pretensioned in a direction transverse to a direction of movement of the rails of the sliding element guide system.

6. The sliding element linear guide system according to claim 1, wherein the synchronization means further comprises a rocker elements, disposed on a opposite central rail side wall portions, wherein the synchronization elements are assembled to be movable on the respective rocker elements, such that an equalization of tolerance is implemented.

7. The sliding element linear guide system according to claim 1, wherein the sliding element rail side wall portions include raceway surfaces and/or the cabinet unit rail side wall portions include raceway surfaces.

8. The sliding element linear guide system according to claim 1, comprising two carriages, wherein the synchronization means are configured to synchronize movement of the two carriages.

9. The sliding element linear guide system according to claim 1, wherein the synchronization means is configured to synchronize a movement of the central rail with a movement of the cabinet unit rail and/or a movement of the sliding element rail.

10. An item of furniture or domestic appliance having a sliding element linear guide system according to claim 1.

11. A sliding element linear guide system, for an item of furniture or for a domestic appliance, wherein the sliding element guide system comprises:

a cabinet unit rail;

a central rail; and a sliding element rail;

a carriage including bearing elements, wherein the carriage comprises a first carriage associated with the cabinet unit rail and the central rail, and a second carriage associated with the sliding element rail, whereby the cabinet unit rail, the central rail, and the sliding element rail are moveably mounted such that the cabinet unit rail, the central rail and the sliding element rail are movable in relation to one another; and synchronization means having a synchronization element, wherein the synchronization means synchronizes movement of elements of the sliding element guide system, wherein the cabinet unit rail and the sliding element rail are configured to have a C-profile-shape, wherein the cabinet unit rail has a cabinet unit rail horizontal wall portion and two cabinet unit rail side wall portions that are mutually spaced apart, wherein the sliding element rail has a sliding element rail horizontal wall portion and two sliding element rail side wall portions, that are mutually spaced apart, wherein the sliding element rail side wall portions and/or the cabinet unit rail side wall portions comprise a planar raceway for the synchronization element, wherein a plane of extent of the raceway of the sliding element rail side wall portion and/or a plane of extent of the raceway of the cabinet unit rail side wall portion extends along a longitudinal extent of the rail elements, wherein the central rail runs between the cabinet unit rail side wall portions and/or the sliding element rail side wall portions, wherein the plane of extent of the raceway of a first sliding element rail side wall portion in relation to the plane of extent of the raceway of a second sliding element rail side wall portion encloses a sliding element rail angle $\delta$, wherein the sliding element rail angle $\delta$ is in an angular range between 0° and less than 180°, and/or wherein the plane of extent of the raceway of a first cabinet unit rail side wall portion in relation to the plane of extent of the raceway of a second cabinet unit rail side wall portion encloses a cabinet unit rail angle $\beta$, wherein the cabinet unit rail angle $\beta$ is in an angular range between 0° and less than 180°, and wherein an internal angle $\alpha$ between a plane of extent of a central rail horizontal wall portion and a plane of extent of a central rail side wall portion is in a range of 30° to 70°.

* * * * *